US009163820B2

(12) United States Patent
Bakk

(10) Patent No.: US 9,163,820 B2
(45) Date of Patent: Oct. 20, 2015

(54) LED LAMP HAVING A COOLING BODY

(75) Inventor: Istvan Bakk, Törökbalint (HU)

(73) Assignee: Tridonic Jennersdorf GmbH, Jennersdorf (AT)

( * ) Notice: Subject to any disclaimer, the term of this patent is extended or adjusted under 35 U.S.C. 154(b) by 392 days.

(21) Appl. No.: 13/504,804

(22) PCT Filed: Sep. 23, 2010

(86) PCT No.: PCT/EP2010/064046

§ 371 (c)(1),
(2), (4) Date: May 10, 2012

(87) PCT Pub. No.: WO2011/051058

PCT Pub. Date: May 5, 2011

(65) Prior Publication Data

US 2012/0218755 A1 Aug. 30, 2012

(30) Foreign Application Priority Data

Oct. 30, 2009 (DE) ..... 10 2009 051 334

(51) Int. Cl.

| | |
|---|---|
| ***F21V 29/00*** | (2015.01) |
| ***F21K 99/00*** | (2010.01) |
| ***F21V 29/77*** | (2015.01) |
| ***F21V 29/83*** | (2015.01) |
| *F21Y 101/02* | (2006.01) |

(52) U.S. Cl.

CPC ..... *F21V 29/004* (2013.01); *F21K 9/135* (2013.01); *F21V 29/773* (2015.01); *F21V 29/83* (2015.01); *F21Y 2101/02* (2013.01)

(58) Field of Classification Search

CPC ..... F21V 29/00; F21V 29/002; F21V 29/004; F21V 29/773; F21V 29/83; F21V 1/00; F21V 21/00; F21K 9/135

See application file for complete search history.

(56) References Cited

U.S. PATENT DOCUMENTS

| | | | | |
|---|---|---|---|---|
| 6,511,209 | B1 | 1/2003 | Chiang | |
| 7,637,635 | B2 * | 12/2009 | Xiao et al. | 362/294 |
| 2007/0279862 | A1 * | 12/2007 | Li | 361/692 |
| 2009/0129102 | A1 * | 5/2009 | Xiao et al. | 362/373 |

(Continued)

OTHER PUBLICATIONS

International Search Report issued in connection with the corresponding International Application No. PCT/EP2010/064046 on Dec. 22, 2010.

(Continued)

*Primary Examiner* — Bao Q Truong
(74) *Attorney, Agent, or Firm* — The H.T. Than Law Group

(57) ABSTRACT

The invention relates to an LED lamp (L), having a light-emitting means with at least one LED, and a heat sink (K1-K6), characterized in that the heat sink (K1-K6) is configured such that a plurality of channels (1, 1', 1", 1''') are formed through said heat sink for transporting away air which is heated by operation of the light-emitting means, wherein the channels (1, 1', 1", 1''') are arranged in the form of a ring around an axis (A), and wherein the length of at least one channel (1, 1', 1", 1''') is at least half the shortest diagonal or transversal in the transverse extent of the corresponding one channel. The arrangement according to the invention and in particular the configuration of the channels (1, 1', 1", 1''') make it possible to achieve particularly effective dissipation of heat.

11 Claims, 7 Drawing Sheets

(56) References Cited

U.S. PATENT DOCUMENTS

Figure 3:
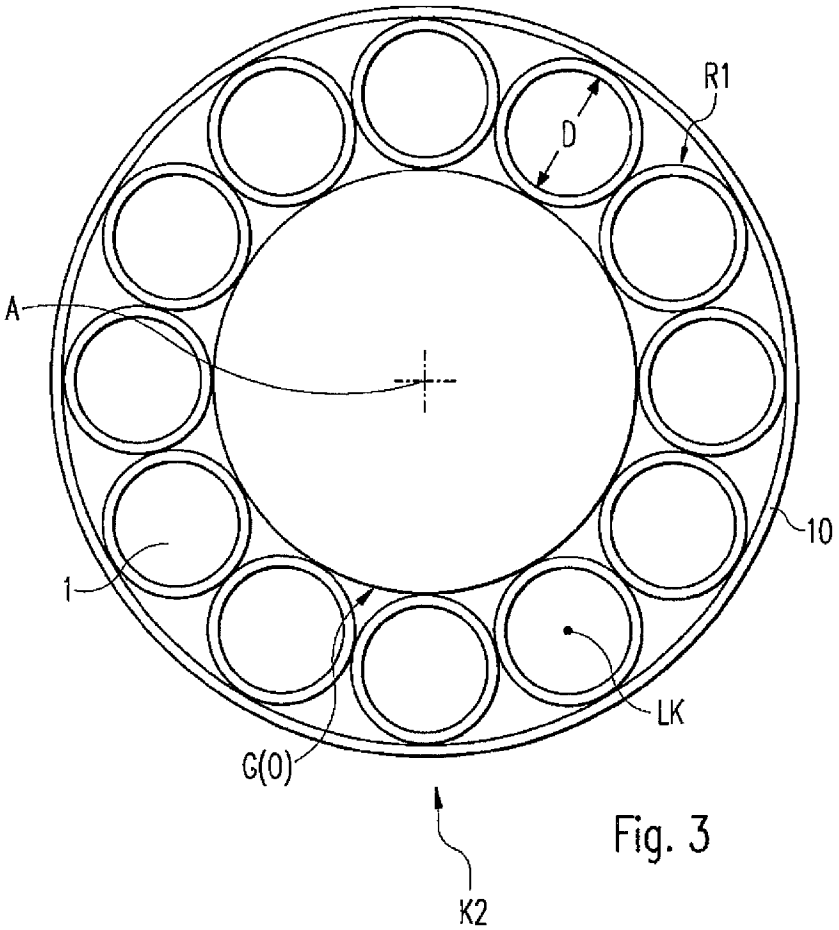

| | | | | |
|---|---|---|---|---|
| 2009/0185380 | A1 | 7/2009 | Ho | |
| 2009/0296387 | A1* | 12/2009 | Reisenauer et al. | 362/235 |
| 2009/0315442 | A1 | 12/2009 | Rooymans | |
| 2010/0096992 | A1* | 4/2010 | Yamamoto et al. | 315/112 |
| 2010/0282446 | A1* | 11/2010 | Yamamoto et al. | 165/109.1 |

OTHER PUBLICATIONS

International Preliminary Report on Patentability in connection to corresponding International Application No. PCT/EP2010/064046.

* cited by examiner

LED LAMP HAVING A COOLING BODY

BACKGROUND OF THE INVENTION

The invention relates to an LED lamp (LED: light-emitting diode), which comprises a light-emitting means with at least one LED and a heat sink.

During operation of an LED lamp, in principle heat is generated, to be precise by the LED or LEDs themselves, but also by a supply circuit ("driver circuit") for the LED(s). This heat is at least partially transferred from said components to surrounding components or the surrounding air. In order to enable as high an efficiency of the lamp as possible, colour stability, possibly colour temperature stability in the case of white LEDs and as long a life of the LED(s) as possible, it is desirable for the heat to be transported away from said components (supply circuit, LED chip) effectively and efficiently, with the result that the temperature of the LED does not rise beyond a certain extent.

The prior art WO 2006/118457 A1 has disclosed a heat sink for an LED lamp. The efficiency of heat dissipation is limited with this heat sink.

The invention is based on the object of specifying LED lamps with improved heat sinks.

SUMMARY OF THE INVENTION

In accordance with one aspect of the invention, according to Claim 1 an LED lamp is provided which comprises a light-emitting means with at least one LED, a supply circuit and a heat sink (in thermal contact therewith). The heat sink is configured such that a plurality of channels are formed through said heat sink for transporting away air which is heated by operation of the light-emitting means. The channels are arranged in the form of a ring around an axis. The length of at least one channel is at least half the shortest diagonal or transversal in the transverse extent of the corresponding one channel.

However it is also conceivable that in each channel of the LED lamp, the length is at least half the shortest diagonal or transversal in the transverse extent of the corresponding channel In accordance with a second aspect of the invention, according to Claim 3 an LED lamp is provided which comprises a light-emitting means with at least one LED, a supply circuit and a heat sink (in thermal contact therewith). The heat sink is configured such that a plurality of channels are formed through said heat sink for transporting away air which is heated by operation of the light-emitting means. The channels are arranged in the form of a ring around an axis. All of the channels together have a transverse extent transversely with respect to the axis and a longitudinal extent longitudinally with respect to the axis, with the longitudinal extent being at least as great as half of the transverse extent.

With such dimensioning, the convectional flow through the channels is improved, in particular as a result of the chimney effect which is established particularly well, with the result that particularly effective heat dissipation is enabled.

Advantageously, the heat sink is configured in such a way that the channels form a first ring structure and a second ring structure, wherein the second ring structure surrounds the first ring structure in relation to the axis. As a result, the surface of both the heat sink itself and of the channels through which air flows is enlarged and therefore the heat dissipation is improved.

In accordance with a third aspect of the invention, according to Claim 5 an LED lamp is provided which comprises a light-emitting means with at least one LED, a supply circuit and a heat sink (in thermal contact therewith). The heat sink is configured such that a plurality of channels are formed through said heat sink for transporting away air which is heated by operation of the light-emitting means. The channels are arranged in the form of a ring around an axis, such that the channels form a first ring structure and a second ring structure, wherein the second ring structure surrounds the first ring structure in relation to the axis.

Owing to the surrounding ring structures of the channels, the area used for transporting away heat is firstly enlarged. In addition, there is also a greater volume of air to flow through available in the heat sink, with the result that heat can be transported away even more effectively and efficiently. This improves in particular the heat conduction, while the size of the heat sink (in comparison to a heat sink with a ring structure) is only increased to a minimum extent.

Advantageously, in the case of the heat sink each of the channels has a cross section with a closed circumference. If possible, the channels should not have a closed circumference over their entire length, but it is also possible for said channels to have a closed circumference over their entire length. In this way, the transport of heat away as a result of the corresponding air flow or convectional flow owing to the chimney effect which is produced as a result of the closed circumference is further improved.

In accordance with a fourth aspect of the invention, according to Claim 7 an LED lamp is provided which comprises a light-emitting means with at least one LED, a supply circuit and a heat sink (in thermal contact therewith). The heat sink is configured such that a plurality of channels are formed through said heat sink for transporting away air which is heated by operation of the light-emitting means. The channels are arranged in the form of a ring around an axis, such that the channels form a first ring structure and a second ring structure. Each of the channels of the first ring structure has a cross section with a closed circumference, and each of the channels of the second ring structure is separated from one another merely by rib wall parts in the circumferential direction in relation to the axis, said rib wall parts extending at least substantially in radial directions.

In this way, it is firstly possible to make use of the advantage of the chimney effect by means of the closed channels while, at the same time, it is additionally possible for heat to be transported away via corresponding cooling ribs while the heat sink has a low weight. In addition, the ring structures, depending on the arrangement thereof, can be used as air guide part for the respective other ring structure by virtue of the air flowing through the first ring structure being directed in a targeted manner into the second ring structure, or vice versa.

Advantageously, the second ring structure and the first ring structure overlap one another at least partially in the longitudinal direction of the axis. As a result, the channels which are upstream in the direction of air flow are firstly used as air guide parts for improved air flow, while at the same time the surface is enlarged in the overlapping region for increased transport of heat away.

Advantageously, each of the channels has a rotationally symmetrical, preferably cylindrical, particularly preferably circular-cylindrical cross section. This ensures a space-saving arrangement of the channels whilst at the same time sufficient contact area for heat transport. In addition, this makes it possible for air to flow through the channels without any disruptive swirling.

The axis is preferably identical to the axis of rotational symmetry or longitudinal axis of the LED lamp.

Advantageously, the first and/or second ring structure each have at least two ring structures. As a result, the transport of heat away as a result of the larger surface and therefore the improved convectional flow with the increased chimney effect which at the same time has an assisting effect is further improved, as a result of which a further increase in the effectiveness of heat dissipation is enabled.

Advantageously, each of the channels has a longitudinal axis which is oriented with respect to the axis in terms of its alignment, as a result of which the air convection can take place in the course of the chimney effect in unimpeded fashion. In this fashion, the longitudinal axes of the individual channels are advantageously not parallel to one another, however. It is thus possible to achieve a reduction in size and additional design features, such as different contour representations.

Advantageously, the channels are separated from one another merely by rib wall parts in the circumferential direction in relation to the axis, said rib wall parts extending at least substantially in radial directions. In this way, heat is transported away with at the same time a low weight of the heat sink Advantageously, the heat sink also has an enveloping part, which is arranged such that it surrounds the channels or at least one ring structure on the outside in relation to the axis, wherein the enveloping part has a cylindrical or conical outer surface, which is preferably designed to be rotationally symmetrical with respect to the axis. This increases the amount of heat transported away, improves the appearance of the heat sink and increases the air conduction for transporting heat away into the channels. Particularly advantageously, for this purpose the enveloping part surrounds all of the channels together or at least one ring structure in the longitudinal direction of the axis, completely or only partially, preferably at least over half of the longitudinal extent.

Advantageously, the enveloping part is configured such that, in the longitudinal direction of the axis, it protrudes beyond all of the channels together or at least one ring structure in one direction or in both directions. As a result, the air flows which are formed in the channels are combined again prior to leaving the heat sink and are not formed until after the air has entered the interior of the heat sink by virtue of being split.

Advantageously, the enveloping part has a preferably circular-cylindrical or conical inner surface, which is arranged so as to be directly adjacent to the radial end regions of the rib wall parts, with the result that an outer limit for at least some of the channels is formed by the enveloping part. In this way, a closed cross section of the channels is achieved in order to safely produce a chimney effect thereby in order to ensure a high level of heat transported away.

Advantageously, the heat sink is designed to be integral. As a result, particularly effective heat conduction within the heat sink is enabled. The heat sink can be made from aluminium and can be in the form of a solid diecasting, for example. Particularly preferably, the heat sink is made from plastic. This is advantageous in terms of the permissible surface temperature because said surface temperature is higher for plastic than for aluminium. This is because the amount of pain which is perceived at a surface temperature of, for example, 70 degrees Celsius is much less with plastic than with aluminium at 70 degrees. Although plastic is generally not suitable for such high temperatures as aluminium, correspondingly lower temperatures can be expected in the outer region of the heat sink under consideration here. In addition, an outer surface of the heat sink can generally be configured more easily and better from an optical and aesthetic point of view than an outer surface made from aluminium.

Advantageously, in total between three and thirty, particularly preferably between six and fifteen, channels are formed in order to firstly make available a large surface for transporting heat away and secondly to dimension the channels correspondingly so as to reliably bring about the chimney effect. This is preferably additionally achieved by virtue of the fact that each of the channels has a cross section with a diameter of at least 4 mm, preferably at least 8 mm, particularly preferably from 5 to 12 mm. In addition, by virtue of the fact that each of the channels preferably extends at least 10 mm in the longitudinal direction of the axis.

Advantageously, the first ring structure is arranged so as to be offset with respect to the second ring structure in relation to the longitudinal direction of the axis. In this way, the channels or ribs arranged downstream in the flow direction additionally act as air guide part for the subsequent channels, as a result of which a strong directional air flow for reliable and effective transport of heat away is made available.

Advantageously, the LED lamp furthermore has a driver housing for accommodating a driver for operating the LED, wherein the driver housing has a surface region which forms an inner limit for at least some of the channels. This makes it possible for heat which is produced during operation of the lamp by the driver to be transported away particularly effectively.

Further advantageously, the driver housing is connected flat to the heat sink for particularly effective heat transfer from the driver to the heat sink Particularly advantageously, the LED lamp has substantially the shape of a conventional incandescent bulb or halogen lamp. In this regard it preferably has: an incandescent lamp or halogen lamp base for mechanical and electrical connection to a corresponding conventional lampholder, and a transparent cover, which emulates a glass bulb of the conventional incandescent bulb or halogen lamp. In this way, the LED lamp can be used universally instead of a conventional incandescent bulb or halogen lamp without any technical modifications needing to be made to the luminaires. In addition, the external appearance remains the same as that for a conventional lamp, as is often desirable.

BREIF DESCRIPTION OF THE DRAWINGS

Figure 1:
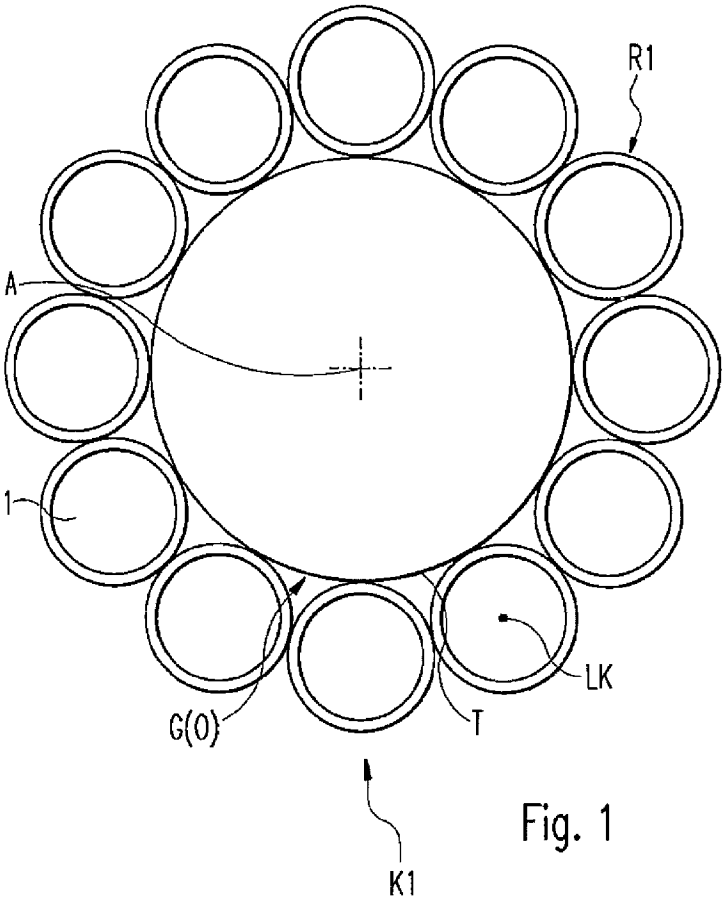
Figure 2:
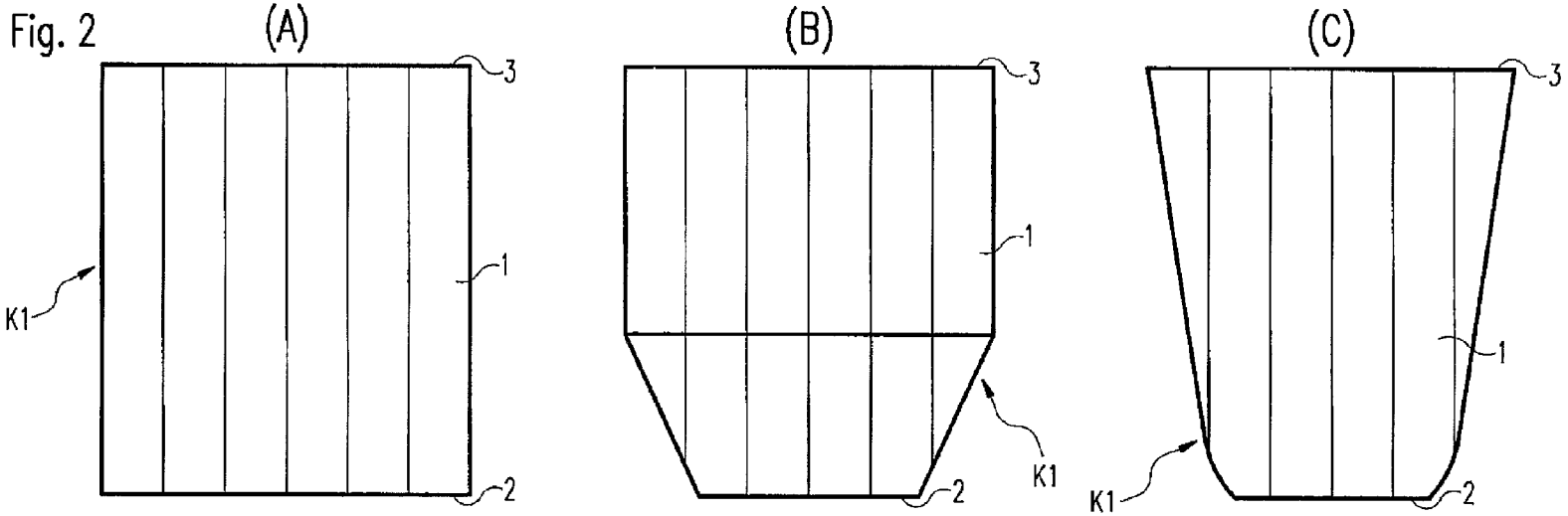
Figure 4:
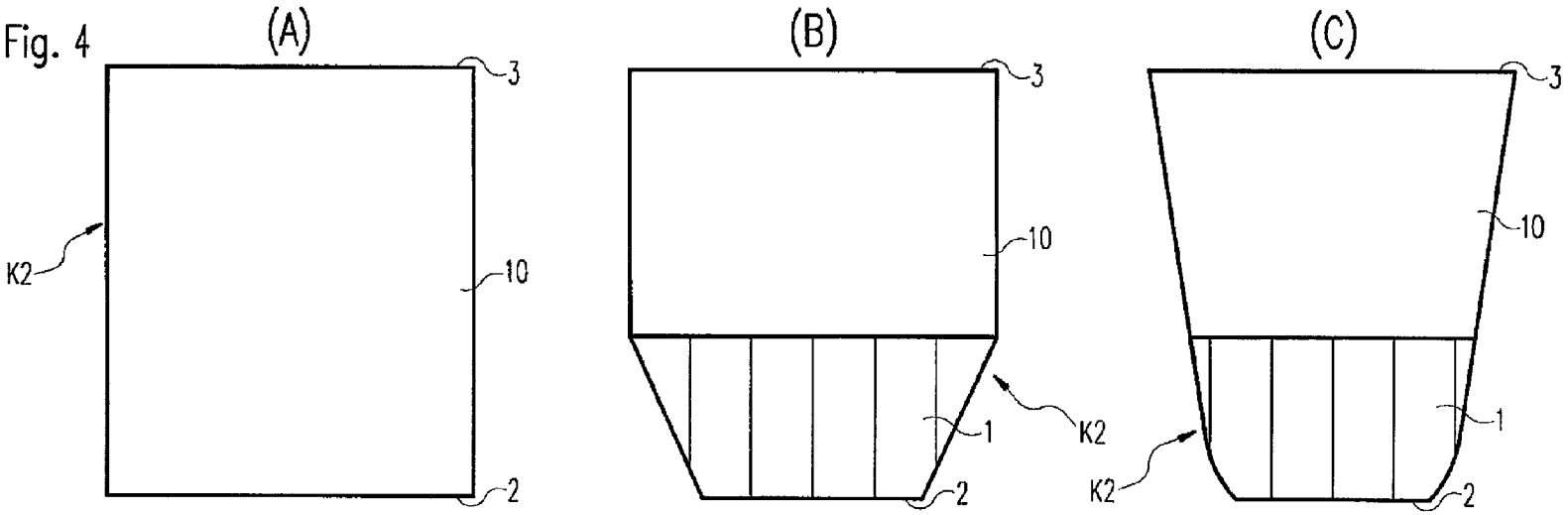
Figure 5:
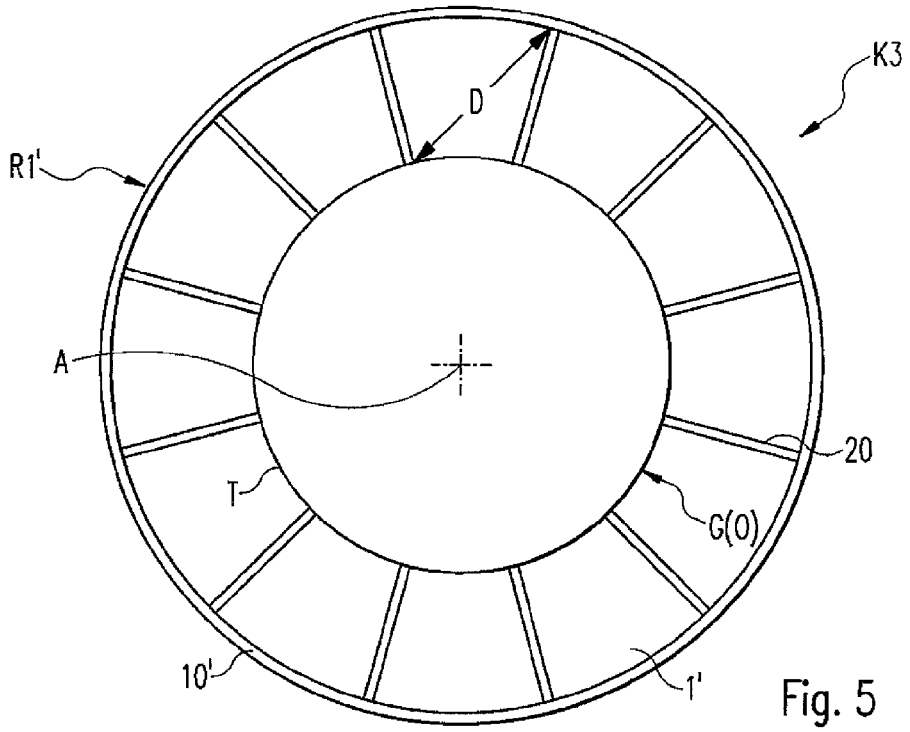
Figure 8:
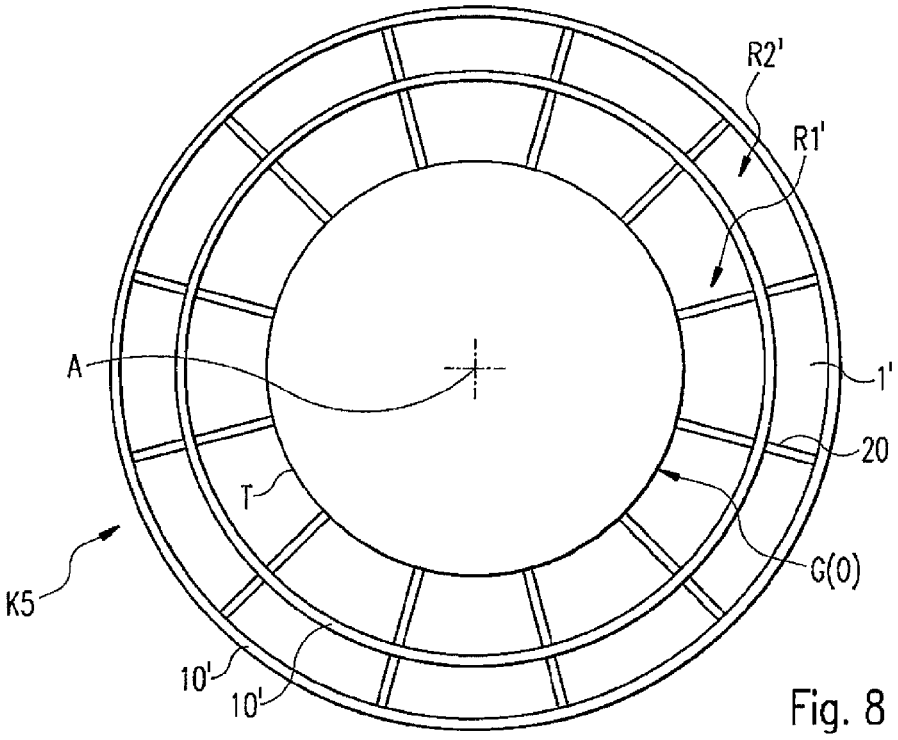
Figure 6:
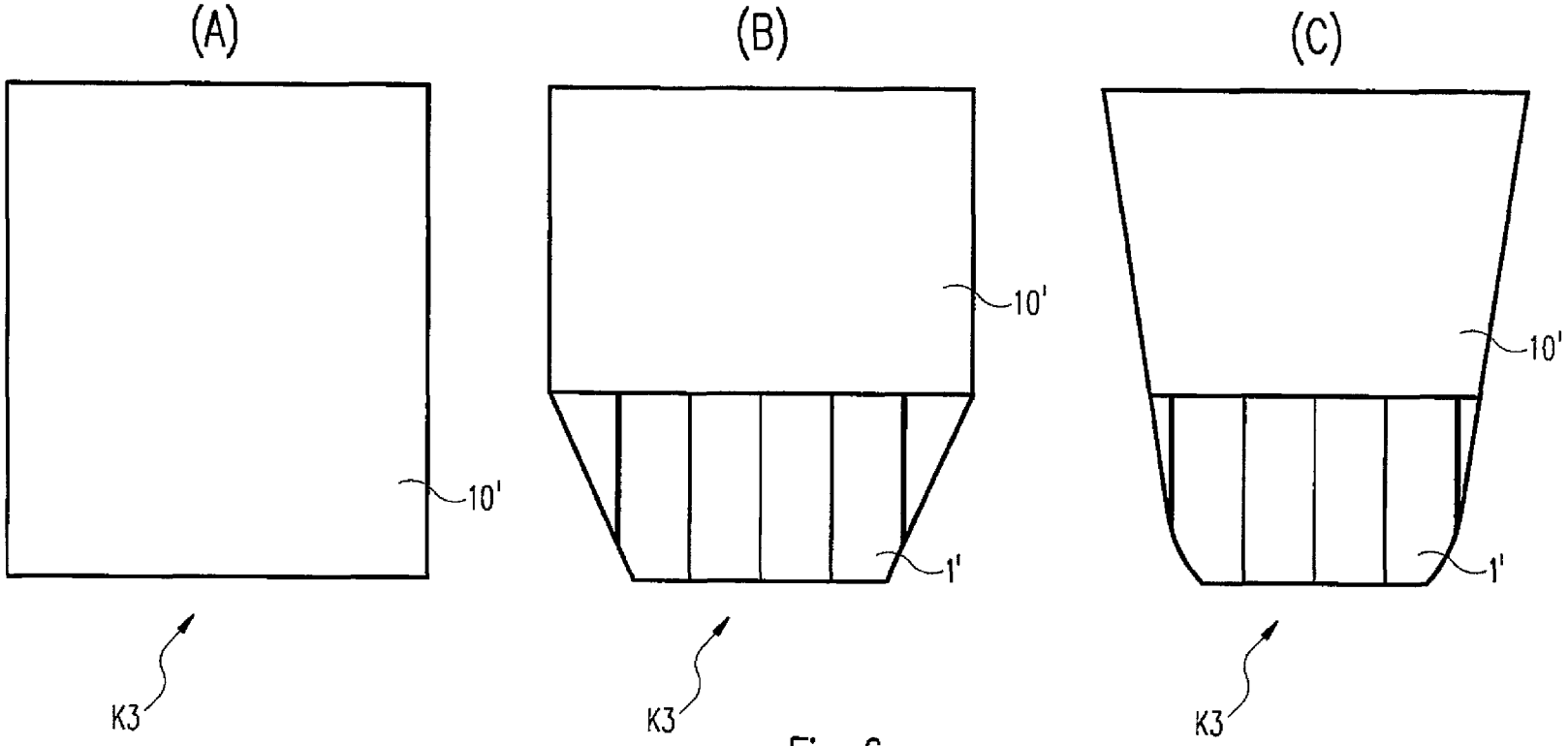
Figure 7:
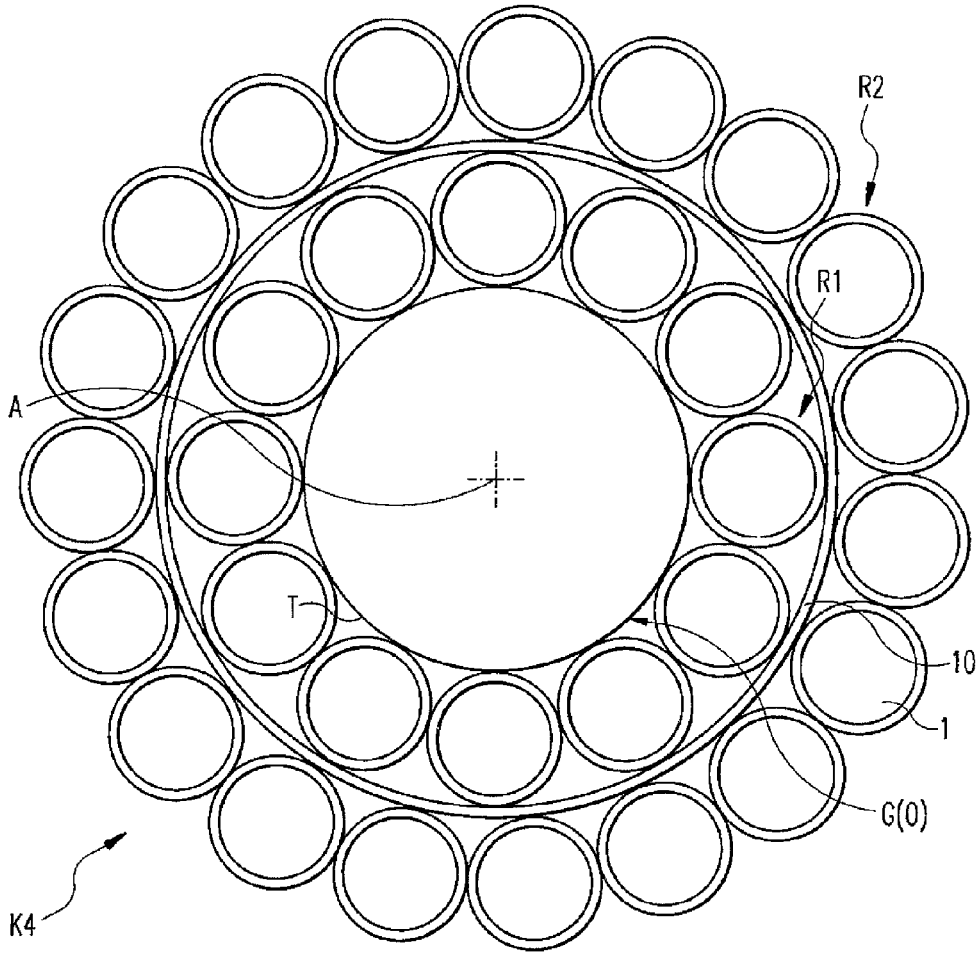
Figure 9:
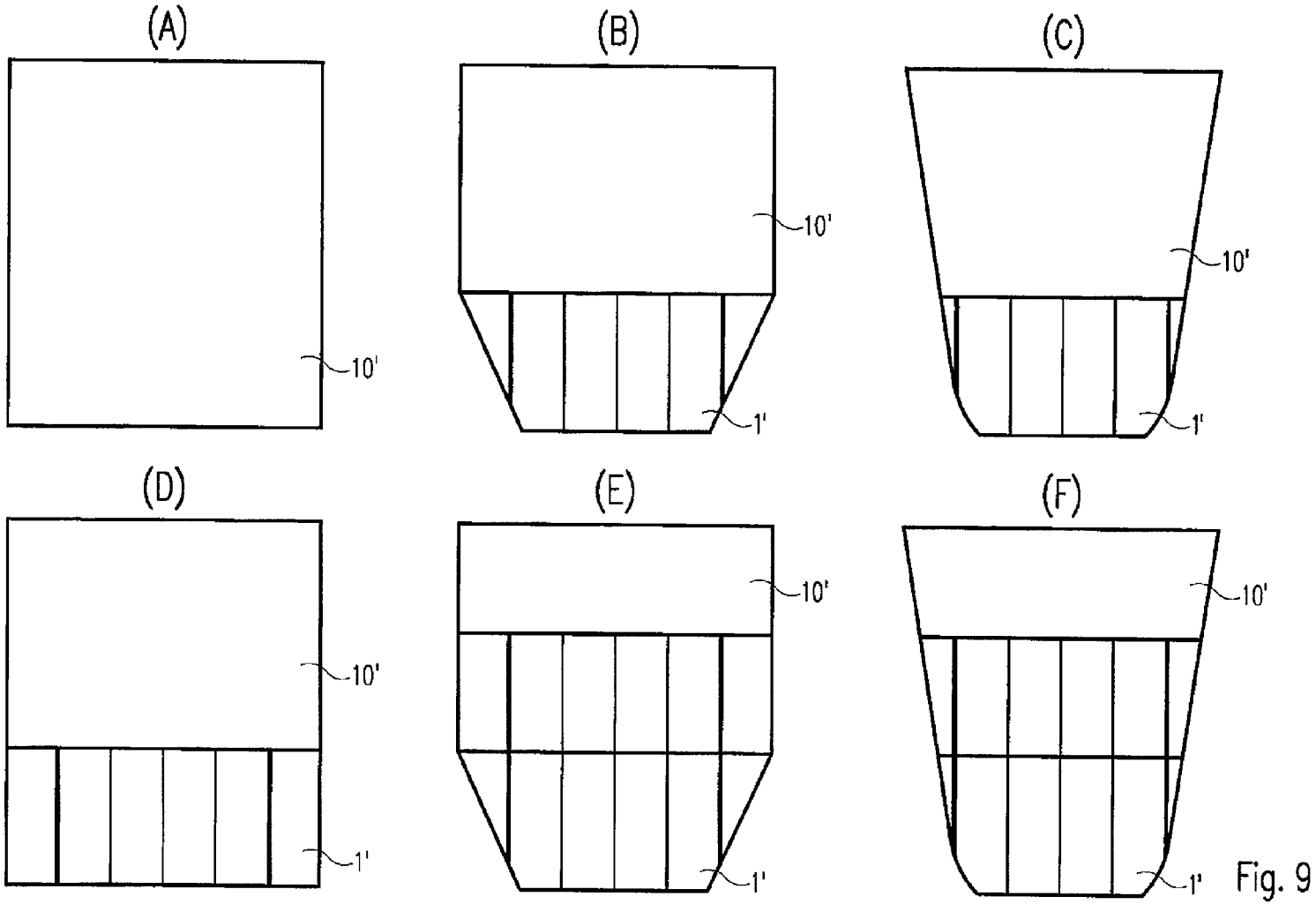
Figure 10:
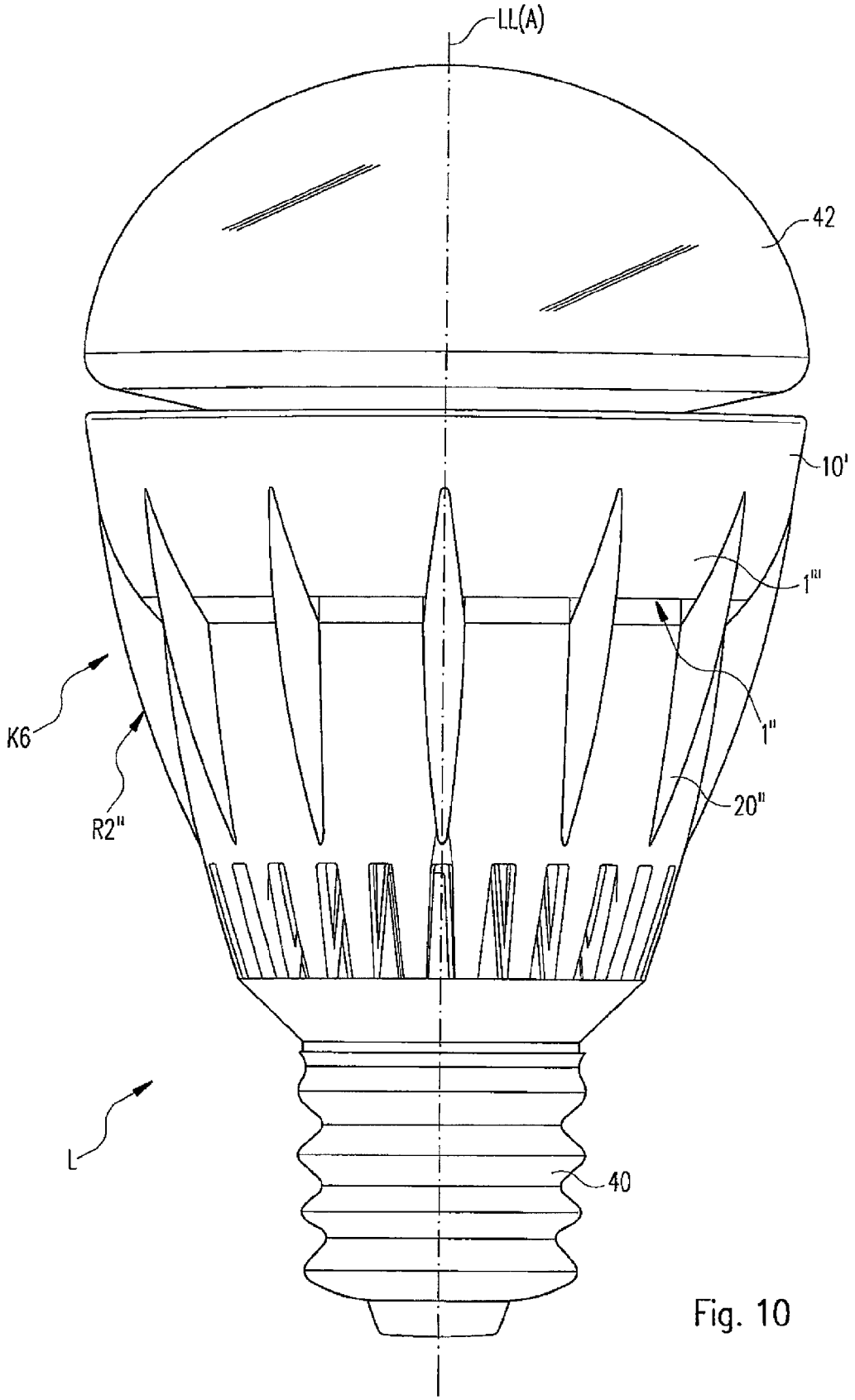

Further features, advantages and properties of the invention will be explained below with reference to exemplary embodiments and the figures in the attached drawings, in which:

FIG. 1 shows a cross-sectional sketch for a first exemplary embodiment of a heat sink according to the invention of an LED lamp with channels with a cylindrical cross section, FIGS. 2A-C show side views of the heat sink shown in FIG. 1, FIG. 3 shows a cross-sectional sketch for a second exemplary embodiment of a heat sink according to the invention of an LED lamp with channels with a cylindrical cross section and with an enveloping part, FIGS. 4A-C show side views of the heat sink shown in FIG. 3, FIG. 5 shows a cross-sectional sketch for a third exemplary embodiment of a heat sink according to the invention of an LED lamp with channels which are separated from one another by rib wall parts in a circumferential direction, FIGS. 6A-C show side views of the heat sink shown in FIG. 5, FIG. 7 shows a cross-sectional sketch for a fourth exemplary embodiment of a heat sink according to the invention of an LED lamp with a plurality of ring structures of channels with a cylindrical cross section, FIG. 8 shows a cross-sectional sketch for a fifth exemplary embodiment of a heat sink according to the invention of an LED lamp with a plurality of ring structures of channels which are separated from one another by rib wall parts in a circumferential direction, FIGS. 9A-F show side views of the heat sink shown in FIG. 8, and FIG. 10 shows a side view of an LED lamp according to the invention with a heat sink in accordance with a sixth exemplary embodiment.

DETAILED DESCRIPTION OF THE INVENTION

FIG. 10 shows a sketch of a side view of an LED lamp L according to the invention. The LED lamp L has a heat sink K6 according to the invention in accordance with an exemplary embodiment. In particular, different heat sinks K1-K6 for LED lamps will be described below using different exemplary embodiments.

The LED lamp L can be designed such that it is suitable as a replacement for a conventional incandescent bulb or halogen lamp. Therefore, in terms of its external appearance, it can have substantially the shape of a conventional incandescent bulb or halogen lamp and/or be equipped with a corresponding thread 40, or an E27 or E14 thread, or a plug (not shown), which thread or plug is used for mechanical and electrical connection to a corresponding conventional lampholder. Such a lamp is therefore often also referred to as a "retrofit LED lamp".

To be more precise, a supply circuit ("driver circuit") T is supplied with voltage starting from the base or plug, said voltage supplying the LED(s) of the lamp with electrical energy in a suitable manner with open-loop or closed-loop control, starting from a supplied AC voltage (for example system voltage) or DC voltage, for example. Such supply circuits are well known in the prior art and are therefore not explained in detail at this juncture. One common feature to all of the supply circuits is that they generate more or less waste heat.

The driver circuit T can be arranged in mechanically and electrically protected fashion in a driver housing G (cf. FIG. 1 for example).

Furthermore, the LED lamp L can correspondingly have a transparent cover 42, which emulates a glass bulb of the conventional incandescent bulb or halogen lamp.

As light source, the LED lamp has a light-emitting means, which comprises at least one LED (not shown). Preferably, the LED lamp emits white light.

During operation of the LED lamp L, heat is generated by the LED and also by the driver circuit T. This heat needs to be transported away as effectively as possible in order to enable reliable and effective operation of the LED lamp L and as long a life of the LED as possible. A heat sink K which is thermally connected to the LEDs and the supply circuit is used for this purpose.

FIG. 1 shows a heat sink K1 in accordance with the first exemplary embodiment. This is formed by a plurality of channels 1, which are arranged in the form of a ring around an axis A and therefore preferably form a ring structure R1. Particularly preferably, the axis A in this case corresponds to the axis of rotational symmetry or longitudinal axis LL of the LED lamp L (cf. FIG. 10).

In a particularly preferred embodiment, the heat sink K1 is in addition designed to be integral. The integral unit can in this case be made from aluminium and be in the form of a solid diecasting, for example. Particularly preferably, the heat sink K1 is made from plastic. This is advantageous as regards the permissible surface temperature because this is higher for plastic than for aluminium. The reason for this is that the degree to which pain is perceived at a surface temperature of 70 degrees Celsius, for example, is substantially lower with plastic than with aluminium at 70 degrees. Although plastic is generally not suitable for such high temperatures as aluminium, correspondingly lower temperatures can be expected in particular in the outer region of the heat sink K1. In addition, an outer surface of the heat sink K1 can generally be configured more easily and better from an optical and aesthetic point of view than an outer surface made from aluminium.

The channels 1 of the heat sink K1 preferably have a cross section with a closed circumference. In this case, each of the channels 1 additionally preferably has a rotationally symmetrical, preferably cylindrical, particularly preferably circular-cylindrical cross section in order to achieve a shape which is as optimum as possible in terms of flow technology with as little swirling as possible. As a result, a space-saving arrangement of the channels 1 with a comparatively low weight and at the same time with a sufficient contact area for transport of heat is also ensured. However, the invention is not restricted to the shapes of the channels 1 described above. Said channels can also have any other cross-sectional shape, for example square, rectangular, polygonal with n corners (n=1, 2, 3, . . . , ∞), oval and other shapes which are not mirror-symmetrical or rotationally symmetrical. In addition, the channels can have different shapes within one structure. The channels can therefore have more than one cross-sectional shape.

Furthermore, the channels can have varying diameters in terms of their overall length, i.e. along their longitudinal axis. For example, channels can be wider at the top than at the bottom of the heat sink.

The channels 1 are used for transporting away air by means of convection, said air having been heated by operation of the LED lamp L, i.e. in particular by the light-emitting means or the LED and/or the driver T. The channels 1 are correspondingly designed such that, during operation of the LED lamp L, an air flow through the respective channels 1 can form as a result of the heat produced in the process. Therefore, the channels 1 are preferably designed such that they can bring about a chimney effect for this air flow in this sense.

Correspondingly, the channels 1 preferably have a cross section with a closed circumference and in addition have a front opening 2 and a rear opening 3, with the result that air can flow in and out of the channels 1. In the drawing shown in FIGS. 2, 4, 6, 9 and 10, in this sense "front" is equivalent to "bottom". All of the channels 1 together have a transverse extent transversely with respect to the axis A and a longitudinal extent longitudinally with respect to the axis A. In order to achieve a particularly effective convectional flow and a particularly effective chimney effect, the longitudinal extent is in this case at least as great as half the transverse extent, for this purpose. By virtue of such dimensioning, the flow of air through the channels 1 is improved in particular owing to the chimney effect which is produced, with the result that particularly effective heat dissipation is enabled. Particularly advantageously, each of the channels 1 has a cross section with a diameter of at least 4 mm, particularly preferably between 6 and 12 mm, in order to achieve an optimum chimney effect. Preferably, the heat sink K1 has between 3 and 30 channels 1 in order to firstly make available a large surface owing to numerous channels 1 for transporting heat away and secondly to dimension the channels 1 corresponding to details mentioned above in order to reliably bring about the chimney effect. However, the invention is not restricted to a specific number of channels 1.

The driver T is arranged within the heat sink K1. In the exemplary embodiment shown, the driver housing G has a surface region O, which forms a largely flat, inner limit for the ring structure R1 of the channels 1. The surface region O can in this case be designed to be cylindrical, in particular circular-cylindrical, in a manner which is advantageous in terms of flow technology. In this way, part of the driver housing G directly adjoins the channels 1, with the result that direct or immediate heat transfer from the driver housing G to the channels 1 is enabled. In this case, the driver T or the housing G thereof is preferably arranged centrally with respect to the axis A in order to achieve particularly effective and uniform heat dissipation over a contact area which is as large as possible. Therefore, the channels 1 are also preferably aligned such that their longitudinal axis LK is oriented parallel to the axis A in order to be able to therefore rest on the LED lamp L in a manner which is as compact as possible around the driver T and therefore to form a surface contact which is as large as possible for transporting away heat. In addition, if the channels 1 are all aligned in such a way, the air convection can also take place unimpeded with the aid of the chimney effect.

FIGS. 2A to 2C show different examples of the configuration of the ring structure R1 of the heat sink K1. In this case, the heat sink K1 can have a cylindrical shape (FIG. 2A) or else a shape which tapers towards one end, when viewed in the longitudinal direction of the axis. Apart from bringing the visual appearance close to the design of conventional incandescent bulbs, this provides the further advantage that more air can enter the channels 1 owing to the bevelled inlet opening, which, together with the chimney effect, improves the process of transporting heat away.

FIG. 3 shows a second exemplary embodiment of the LED lamp according to the invention. This substantially corresponds to the LED lamp in accordance with the first exemplary embodiment. If no details are given to the contrary, the statements relating to the first exemplary embodiment therefore also apply similarly to the second exemplary embodiment. The reference symbols are used correspondingly.

The heat sink K2 of the LED lamp in accordance with the second exemplary embodiment also has an enveloping part 10, in contrast to that in accordance with the first exemplary embodiment. This enveloping part is arranged in such a way that it surrounds the channels 1 or the ring structure R1 of channels 1 externally in relation to the axis A. As is shown in FIGS. 4A to 4C, the enveloping part 10 in this case preferably has a cylindrical or conical outer surface, which is also preferably designed to be rotationally symmetrical with respect to the axis A. The enveloping part 10 can surround all of the channels 1 together or the ring structure R1 in the longitudinal direction of the axis A completely or only partially, preferably at least over half the longitudinal extent. Owing to the points of contact shown in FIG. 3 between the enveloping part 10 and the respective channels 1 of the ring structure R1, heat is therefore transported away via the enveloping part 10 as well in consequently increased form. In addition, the corrugated outer structure of the ring structure R1, in particular in the case of channels 1 with a circular cross section, can be covered, and therefore the appearance of the heat sink K2 can be improved.

In addition, the enveloping part 10 is configured in such a way that, in the longitudinal direction of the axis, it protrudes beyond all of the channels 1 together or the ring structure R1 in one direction or in both directions. As a result, the air flows which are formed in the channels 1 are combined again prior to leaving the heat sink K2 or are not formed until after the air has entered the interior of the heat sink K2 by virtue of being split, as a result of which a uniform and reliable air flow is ensured. In addition, the air flow is aligned corresponding to the channels 1 even at an early stage and is therefore directed into said channels 1 in a targeted manner and ensures effective transport of heat away. The enveloping part 10 is preferably designed to be integral with the heat sink K2.

It is also advantageous to produce those regions of the heat sink K2 which face the driver T from aluminium and those regions which face away from the driver T, such as the enveloping part 10, for example, from plastic in order to enable best-possible heat conduction, to avoid injury as a result of the lower degree of perception of pain with plastic in comparison with aluminium and in order to ensure possibilities for the outer configuration of the heat sink K2 which are as broad, aesthetic and creative as possible.

FIGS. 5 and 6A to 6C show a further exemplary embodiment of a heat sink K3 according to the invention for an LED lamp. This substantially corresponds to the LED lamp in accordance with the abovementioned exemplary embodiments. If no details are given to the contrary, the statements relating to the preceding exemplary embodiments therefore also apply similarly to the third exemplary embodiment. The reference symbols are used correspondingly.

In contrast to the abovementioned exemplary embodiments, FIG. 5 shows a heat sink K3 when channels 1' which are separated from one another merely by rib wall parts 20 in a circumferential direction in relation to the axis A, said rib wall parts 20 extending at least substantially in radial directions. In addition, the exemplary embodiment shown shows that the channels 1' preferably have a closed circumference in cross section, which is additionally preferably formed by an additional enveloping part 10' around the channels 1' or the ring structure R1'. The enveloping part 10' can in this case have a preferably circular-cylindrical or conical inner surface, which is arranged directly adjacent to the radial end regions of the rib wall parts 20, with the result that an outer limit for at least some of the channels 1' is formed by the enveloping part 10' (cf. also FIGS. 6A-6C). In this way, a closed cross section of the channels 1' is achieved in order therefore to safely produce a chimney effect and to effectively ensure heat dissipation. The enveloping part 10' can also be formed integrally with the heat sink K3.

This configuration provides a particularly simple way of forming a heat sink K3 which can be shaped directly in one piece with the housing of the LED lamp or with the driver housing G, for example. In addition, the outer appearance in particular of a retrofit LED lamp is not impaired by a heat sink K3 with this design. Instead, said heat sink can be shaped correspondingly directly during manufacture in a simple manner and does not require any further components to adapt it visually.

FIG. 7 shows a fourth embodiment of the heat sink K4 according to the invention which corresponds substantially to that of the second exemplary embodiment, and FIGS. 8 and 9A to 9F show a fifth embodiment of the heat sink K5 according to the invention which substantially corresponds to that of the third exemplary embodiment. If no details are given to the contrary, the statements relating to all of the preceding exemplary embodiments therefore also apply similarly to the fourth and fifth exemplary embodiments. The reference symbols are used correspondingly.

In accordance with these exemplary embodiments, the channels 1, 1', in a manner similar to the abovementioned first ring structure R1, R1', form a second ring structure R2, R2', which in turn is arranged in the form of a ring around the axis A. However, it is also conceivable for the first ring structure R1, R1' and/or the second ring structure R2, R2' to each have at least one further, i.e. at least two ring structures. In accordance with the embodiments shown, the second ring structure R2, R2' surrounds the first ring structure R1, R1' in relation to the axis A. Owing to the formation of two ring structures or two "chimneys", it is possible to form a particularly effective air flow for transporting away the heat produced during operation of the LED lamp. This is because, firstly, the area used for transporting heat away is enlarged by the surrounding ring structures R1, R1', R2, R2' of the channels 1, 1'. In addition, there is secondly also a larger volume of air to flow through in the heat sink K4, K5, with the result that heat can be transported away more effectively and efficiently. Therefore, the thermal conduction is in particular improved, while the size of the heat sink K4, K5 is only increased to a minimum extent in comparison with a heat sink with only one ring structure R1, R1'.

However, according to the invention it is also possible for the mutually surrounding ring structures R1, R1' R2, R2' to only partially overlap one another, i.e. surround one another, or else to be arranged offset with respect to one another in such a way that they are arranged one behind the other, when viewed in the longitudinal direction of the axis A, and in particular in the flow direction of the channels 1, 1', i.e. no longer overlap one another in a cross-sectional region of the LED lamp. In the latter case, the ring structures R1, R1', R2, R2' can be arranged with respect to one another in such a way that the air flow is guided directly and in a targeted manner with respect to the downstream ring structure through the upstream ring structure in the direction of flow, and more efficient air flow with improved heat dissipation is therefore made available.

If, as shown in FIG. 8, the channels of all the ring structures R1', R2' are formed by rib wall parts 20 in the circumferential direction in relation to the axis A, said rib wall parts 20 extending at least substantially in radial directions, it is expedient, in particular when the ring structures R1', R2' surround or overlap one another, if the rib wall parts 20 extend continuously from the first ring structure R1' up to the outer end, when viewed in the radial direction, of the second ring structure R2'. In this way, rapid transport of heat away over the entire area of the heat sink K5 and therefore effective transport of heat away is also assisted by the outer ring structure R2' since the dissipation of heat is distributed uniformly and rapidly over the entire heat sink K5.

In accordance with the fourth aspect of the invention (cf. FIG. 10 as well), each of the channels 1" of the first ring structure R1" has a cross section with a closed circumference, and each of the channels 1'" of the second ring structure R2" is separated from one another merely by rib wall parts 20" in the circumferential direction in relation to the axis A, said rib wall parts 20" extending at least substantially in radial directions. Therefore, firstly the weight of the heat sink K6 can be reduced, while at the same time particularly effective heat dissipation can be ensured owing to the chimney effect with respect to the first ring structure R1" and by means of the cooling ribs 20" of the second ring structure R2".

The channels in the first and the second ring structure can in this case have different lengths. Even the channels within one ring structure can have different lengths.

Owing to the fact that the channels can now have different lengths and can also have different diameters D, there is now a varying length and varying diameter for all of the channels together. Therefore, all of the channels together have a specific width which represents the shortest diameter of all of the channels together. Owing to the varying length, all of the channels together likewise have a specific diagonal and/or transversal which represents the shortest diagonal and/or transversal of all of the channels together.

As a result, each individual channel therefore naturally has a specific width, which represents the shortest diameter of the channel. Owing to the varying length, the channel likewise has a specific diagonal and/or transversal which represents the shortest diagonal and/or transversal of the channel.

In addition, as shown in FIG. 10, when the ring structures R1", R2" are offset with respect to one another, in addition the air flow can be guided in a targeted manner into the closed channels 1" by means of the rib wall parts or rib structure 20", as a result of which the chimney effect is assisted, the air flow is increased and therefore the heat dissipation is improved. Conversely, it is also possible for the air flow emerging from the closed channels to be guided in a targeted manner onto cooling ribs which may be positioned behind said channels in order to therefore improve the heat dissipation by virtue of increased air flow. In order to achieve a positive effect, such as a strong directional air flow, for example, it is not relevant with the abovementioned arrangement whether the outer or inner ring structure or channels or the ring structure or channels which is/are upstream or downstream in the direction of air flow are closed or in the form of ribs and whether possibly one of the abovementioned features is at least partially surrounded by an enveloping part.

As in the abovementioned exemplary embodiments, it is thus possible for a corresponding enveloping part to be provided in the fourth and fifth and in the latter exemplary embodiment. Said enveloping part can be arranged either only between the first ring structure R1, R1', R1" and the second ring structure R2, R2', R2" (cf. also FIG. 7), i.e. the first ring structure R1, R1' is surrounded on the outside in relation to the axis, or only the second ring structure R2, R2' is surrounded on the outside in relation to the axis A or both ring structures R1, R1', R2, R2' are surrounded on the outside in each case in relation to the axis A. In this case, the channels 1, 1', as are shown in FIGS. 7 and 8, can each have the same shape. The channels 1, 1' of the respective ring structures R1, R1', R2, R2' are not tied to a specific shape, even with respect to one another, however, with the result that, for example, the first ring structure R1, R1' has channels with a circular cross section, while the channels of the second ring structure R2, R2' or any other ring structure have a different shape. The channels within a ring structure R1, R1', R2, R2' can also differ from one another. For example, rib structure and closed structure can also alternate in the circumferential direction of the ring structure R1, R1', R2, R2'.

In addition, the invention is also not restricted to one and two ring structures. Instead, any desired number of ring structures can surround one another and/or be arranged offset with respect to one another and/or so as to partially overlap one another. Advantageously, in this case the ring structures are arranged so as to be offset with respect to one another in ideal fashion, in particular in the case of rotationally symmetrical channels. In this way, a compact structure can be achieved which can be used to virtually maintain the external configuration of the heat sink, even in the case of numerous channels, while at the same time providing particularly effective transport of heat away as a result of a large contact area and a high number of channels.

The respective ring structures R1, R1', R2, R2' and/or the enveloping part 10, 10' thereof can protrude towards the front and/or towards the rear with respect to the respective other ring structures R1, R1', R2, R2' and/or enveloping parts 10, 10' in a manner which is advantageous in terms of flow technology. If, for example, the enveloping part 10, 10' which surrounds the second ring structure R2, R2' extends further towards the rear than the first ring structure R1, R1' or the enveloping part 10, 10' thereof, the "partial air flow" through the first ring structure R1, R1' and the "partial air flow" through the second ring structure R2, R2' are combined before the air combined from these two partial air flows flows out of the heat sink again. If, for example, the enveloping part 10, 10' of the first ring structure R1, R1' does not extend as far forwards as that of the second ring structure R2, R2', the air flowing into the heat sink is not split into the two mentioned partial air flows until it is within the heat sink.

Moreover, the invention is not restricted to the abovementioned exemplary embodiments. Any combinations of ring structures, channels, enveloping parts and rib wall parts and shape and arrangement with respect to one another thereof are also included in the scope of the patent claims of this invention.

List of Reference Symbols

1, 1', 1", 1'" Channels
2 Front opening
3 Rear opening
10, 10' Enveloping part
20, 20" Rib wall part
40 Thread
42 Transparent cover
A Axis of heat sink
G Driver housing
K1-K6 Heat sink
L LED lamp
LK Longitudinal axis of channels
LL Longitudinal axis of LED lamp
O Surface region of driver housing
R1, R1', R1" First ring structure
R2, R2', R2" Second ring structure
T Driver
D Diameter of channel

The invention claimed is:

1. LED lamp (L), having:

a light-emitting means with at least one LED, a supply circuit for the at least one LED, a heat sink (K1-K6), and a driver housing (G) for accommodating a driver (T) for operating the LED, wherein the heat sink (K1-K6) is made of plastic, wherein the heat sink (K1-K6) is configured such that a plurality of channels (1, 1', 1", 1'") are formed through said heat sink for transporting away air which is heated by operation of the light-emitting means, wherein the channels (1, 1', 1", 1'") are arranged in the form of a ring around an axis (A), and wherein the driver housing (G) has a surface region (O) which forms an inner limit for at least some of the channels (1, 1', 1", 1'") and directly adjoins the plastic heat sink (K1-K6).

2. LED lamp (L), having:

a light-emitting means with at least one LED, a supply circuit for the at least one LED, a heat sink (K1-K6), and a driver housing (G) for accommodating a driver (T) for operating the LED, wherein the heat sink (K1-K6) is integral and is made of plastic, wherein the heat sink (K1-K6) is configured such that a plurality of channels (1, 1', 1", 1'") are formed through said heat sink for transporting away air which is heated by operation of the light-emitting means, wherein the channels (1, 1', 1", 1'") are arranged in the form of a ring around an axis (A), wherein the driver housing (G) has a surface region (O) which forms an inner limit for at least some of the channels (1, 1', 1", 1'") and which is connected to the heat sink (K1-K6).

3. LED lamp (L) according to claim 1, which is configured such that the channels (1, 1', 1", 1'") form a first ring structure (R1, R1', R1") and a second ring structure (R2, R2', R2"), wherein the second ring structure (R2, R2', R2") surrounds the first ring structure (R1, R1', R1") in relation to the axis (A).

4. LED lamp (L) according to claim 1, in which each of the channels (1, 1') has a cross section with a closed circumference.

5. LED lamp (L) according to claim 1, wherein the heat sink (K1-K6) is designed to be integral.

6. LED lamp (L) according to one of claim 3, wherein the first ring structure (R1, R1', R1") is arranged so as to be offset with respect to the second ring structure (R2, R2', R2") in relation to the longitudinal direction of the axis (A).

7. LED lamp (L) according to claim 1, which has substantially the shape of a conventional incandescent bulb or halogen lamp, and further has:

an incandescent lamp or halogen lamp base (40) for mechanical and electrical connection to a corresponding conventional lampholder, and a transparent cover (42), which emulates a glass bulb of the conventional incandescent bulb or halogen lamp.

8. LED lamp (L) according to claim 1, wherein the channels (1, 1', 1", 1'") have varying diameters (D) along the longitudinal axis thereof.

9. LED lamp (L) according to claim 1,wherein the heat sink (K1-K6) has a shape which tapers towards one end, when viewed in the longitudinal direction of the axis.

10. LED lamp (L) according to claim 1, wherein the connection between the surface region (O) of the driver housing (G) and the heat sink (K1-K6) is flat.

11. LED lamp (L) according to claim 2, wherein the connection between the surface region (O) of the driver housing (G) and the heat sink (K1-K6) is flat.

* * * * *